United States Patent [19]

Baker

[11] Patent Number: 5,049,708

[45] Date of Patent: Sep. 17, 1991

[54] NORMALLY CLOSED PRESSURE RESPONSIVE SWITCH

[76] Inventor: Gary A. Baker, 231 Cranberry Ridge Rd., North Scituate, R.I. 02857

[21] Appl. No.: 529,060

[22] Filed: May 25, 1990

[51] Int. Cl.[5] ..... H01H 35/34

[52] U.S. Cl. ..... 200/83 P; 200/83 J; 200/83 N

[58] Field of Search ..... 200/83 P, 83 J, 83 N, 200/83 R

[56] References Cited

U.S. PATENT DOCUMENTS

| | | | |
|---|---|---|---|
| 4,091,249 | 5/1978 | Huffman | 200/83 P |
| 4,342,887 | 8/1982 | Sanford | 200/83 P |
| 4,861,953 | 8/1989 | Sanford | 200/83 P |
| 4,948,931 | 8/1990 | Nixon et al. | 200/83 P |

*Primary Examiner*—Harold Broome
*Attorney, Agent, or Firm*—John A. Haug; James P. McAndrews; Melvin Sharp

[57] ABSTRACT

A normally closed pressure responsive switch has upper and lower housings attached to one another with an electrically conductive snap acting disc placed therebetween. The lower housing includes a base having a recessed area in which a stationary electrical contact is mounted. The snap acting disc is placed on top of the base with a side having a convex configuration facing the stationary contact. An electrically conductive member is placed over the disc with a plurality of contact tabs engageable with the outer peripheral portion of the disc. The upper housing includes a retainer having a bore in which a pressure converter slides. Ribs formed on the bottom of the pressure converter are adapted to engage the outer peripheral portions of the disc between the contact tabs and are captured in grooves of the retainer to restrict angular movement of the pressure converter. A flexible membrane is placed on top of the retainer and pressure converter and an O-ring is received on top of the membrane to seal the pressure receiving surface of the flexible membrane to a pressure source when the switch is mounted for use.

13 Claims, 3 Drawing Sheets

NORMALLY CLOSED PRESSURE RESPONSIVE SWITCH

BACKGROUND OF THE INVENTION

1. Field of the Invention

This invention relates to a pressure switch and, more specifically, to a pressure responsive switch for mounting on a printed wiring board or an insert molded lead frame which is capable of operating in the normally closed condition.

2. Brief Description of the Prior Art

It is relatively standard in the automotive art to control various functions by means of microprocessor based control units to obtain performance improvements.

One such application has included the operation of the transmission system by integrating engine and transmission control. Such operation requires that the transmission control be compatible with the engine control module (ECM) and be electronically accessible with inputs and outputs. One such prior art approach has utilized solenoid valves to effect gear shifting using pressure switches in the solenoid valve assembly as a way to confirm that solenoid valve actuation and deactuation has occurred responsive to pressure change in the hydraulic fluid. This pressure change is sensed using conventional snap acting pressure responsive switches which close or open electrical circuits on the occurrence of selected pressure levels. A problem with switches of this type is that snap acting switches have a lower life expectancy than is desired.

In U.S. Pat. No. 4,758,695 there is disclosed an attempt to minimize this problem wherein a control system is provided where a metallic diaphragm is used having significantly improved longevity. Such diaphragms are formed with a central dished portion having a pressure deflection relationship such that the diaphragm is relatively stiff, having a positive coefficient of pressure with increasing deflection up to and above a relatively narrow range of set points or calibrated pressures. Within the range of set points the effective spring rate of the diaphragm is relatively supple with only a small increase in pressure resulting in relatively larger travel of the center of the diaphragm. The diaphragms are also characterized in having significantly less hysteresis than conventional snap acting discs to minimize the build up of stresses in the diaphragm since these stresses serve to limit the longevity of the diaphragm. Among the embodiments disclosed are switches in which the diaphragms are formed with an annular flat berm portion which is received on an electrical contact member with an 0-ring disposed on top of the berm and biased thereagainst to form a fluid pressure seal by a tubular sleeve which communicates with an hydraulic fluid pressure source. Another embodiment provides a sleeve formed in two segments with the 0-ring sandwiched therebetween so that the sleeve itself engages the berm portion. An electrical contact rivet is placed beneath the central dished portion and connected to a suitable electrical connector. While the berm provides a convenient way to mount and seal the diaphragm, the integral interconnection between the flat berm portion and the central dished portion results in limiting the life of the diaphragm. In other embodiments, the entire diaphragm is dished and maintained on the electrical contact member by means of a thin flexible membrane which also provides a seal for the switch. However, the use of a membrane to retain the diaphragms in their respective seats limits the positioning of the stationary center contact to the low pressure side of the diaphragm (to close a circuit upon pressure increase. That is, the membrane would preclude the use of a fixed contact on the high pressure side of this diaphragm (to open a circuit upon selected pressure increase.)

A further improvement in the prior art is set forth in U.S. Pat. No. 4,861,953 by forming the entire surface of the diaphragm into a dished configuration with the center of the diaphragm having a pressure versus deflection relationship such that for increasing pressure from 0 psig up to and beyond a plateau having a range of deflections between d1 and d2, the diaphragm has a relatively stiff effective spring rate with the center deflecting between d1 and d2 at essentially the same pressure level, the diaphragm also having a relatively narrow differential between the pressure at which the center of the diaphragm deflects between d1 and d2 on increasing pressure and the pressure at which it deflects between d2 and d1 on decreasing pressure.

In application Ser. No. 07/286,726, filed December 20, 1988 and assigned to the assignee of the instant invention, switches are described comprising, in one embodiment, upper and lower housings with a snap acting member and an electrically conductive member sandwiched between the upper and lower housings. The upper housing includes an electrically insulating body with a hollow center portion which is molded around an electrically conductive member having a contact portion in the hollow center portion, the conductor extending externally of the insulating body. The snap acting member is in constant engagement with the sandwiched electrically conductive member and normally in engagement with the contact of the upper housing. When a pressure is applied which is sufficient to cause the snap acting member to snap into its second stable state, the engagement thereof with the contact in the upper housing is broken and engagement is made with the contact in the lower housing.

The switch can be provided as normally closed by removing the portion of the conductor on the lower housing which extends externally of said member. The switch can be provided as normally open by removing the portion of the conductor on the upper housing which extends externally of said member.

However, when used as a normally closed switch the structure of application Ser. No. 07/286,726 described above has certain limitations which would be desirable to overcome. One such limitation relates to the fact that when used with transmission systems contaminants in the fluid can get into the switching area of the switch causing short circuits and changes in calibration. Further, the fluids cause films to form on the disc and other contact surfaces which then necessitate higher contact force than is available in that structure to make effective electrical engagement. Another limitation relates to the high loading involved with mounting the switch to obtain an effective seal which can cause a shift in the position of the stationary contact due to the location of an O-ring which transmits force through a portion of the top housing which can bend. Yet another limitation relates to problems of dislodgement of the O-ring seal during assembly thereby causing leakage problems.

It is therefore an object of the present invention to provide a pressure responsive switch particularly useful in applications involving engine control modules (ECM) or the like which are normally closed which overcome the above noted limitations.

SUMMARY OF THE INVENTION

Briefly, in accordance with the invention, there is provided upper and lower housings with a snap acting disc sandwiched therebetween. The lower housing includes a base having a recessed area in which a stationary electrical contact is mounted. The contact has an integrally attached terminal extending outwardly beyond the base. The snap acting disc is placed on top of the base with a side having a convex configuration facing the stationary contact. According to a feature of the invention an electrically conductive member having a centrally located opening therethrough is placed over the disc with a plurality of contact tabs extending inwardly into the opening and in electrical engagement with outer peripheral portions of the disc. The electrically conductive member has an integrally attached terminal extending outwardly beyond the lower housing. According to another feature of the invention, the upper housing comprises a retainer having a centrally disposed bore therethrough in which is slidably mounted a pressure converter. The pressure converter has a body portion with a flat top surface and a plurality of ribs on its bottom surface extending radially beyond the body and each being received in a groove formed in the retainer so that angular movement of the converter is restricted, the groove being closed on the top by a wall thereby limiting upward movement of the converter. The ribs are formed with a recessed portion in the center of the converter to provide space for the disc to snap to its opposite, open contacts configuration. The outer portion of the ribs are engageable with outer peripheral surface portions of the disc. A plurality of posts depend from the retainer and are received in mating bores in the base and, according to another feature of the invention, cooperate with locating detents formed in the electrically conductive member to position the contact tabs between ribs of the pressure converter.

A flexible membrane is placed over the pressure converter and the retainer and an O-ring having a centrally disposed button integrally attached thereto is received on the retainer adjacent to an upwardly extending flange with the bottom received through a centrally disposed bore in the membrane and pressure converter to affix the O-ring, membrane and converter together.

DESCRIPTION OF PREFERRED EMBODIMENT

Figure 1:
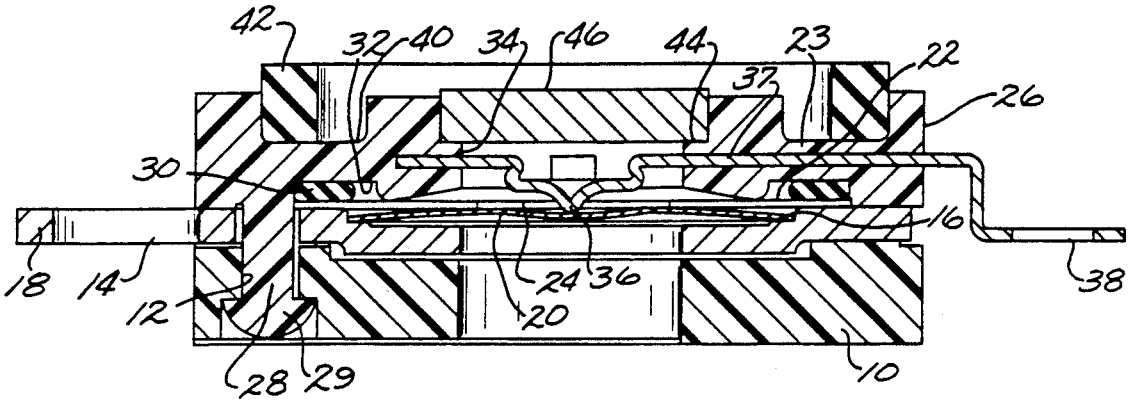
Fig. 1. PRIOR ART
FIG. 1 is a cross sectional view through a prior art switch.
Figure 2:
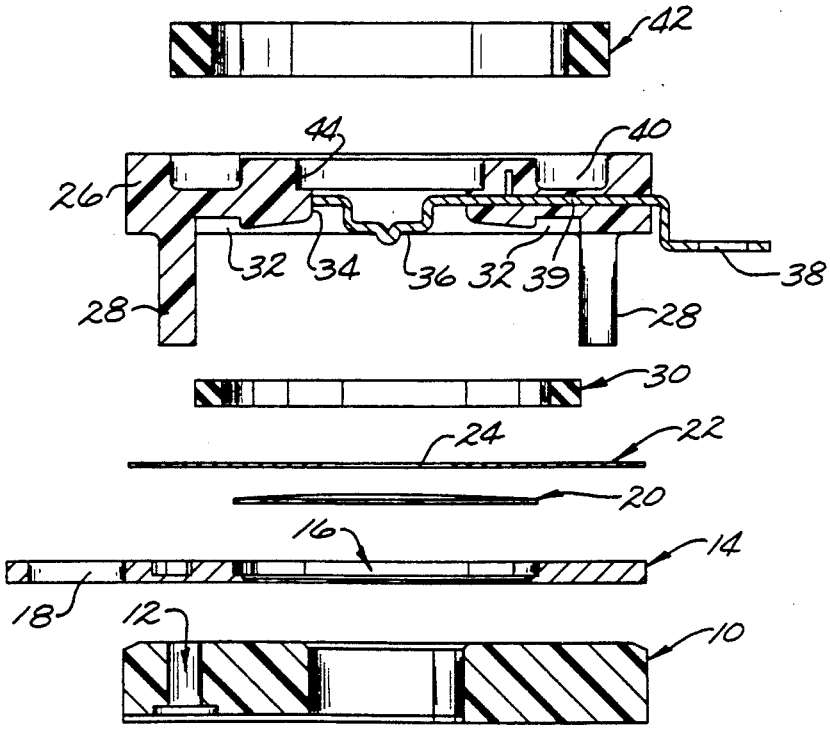
PRIOR ART Fig. 2.
FIG. 2 is an exploded view of the FIG. 1 switch.

With reference to FIGS. 1 and 2 there is shown a normally closed switch as set forth in greater detail in application Ser. No. 07/286,726 supra, comprising a generally circular base 10 formed of electrically insulative material with a plurality of bores 12 (only one being shown) to receive mating post members to be discussed infra. An electrically conductive member 14 is disposed on top of base 10 and has a disc receiving seat 16 formed thereon and a terminal tab 18 extending radially outwardly therefrom. An electrically conductive, snap acting disc having a normally upwardly facing convex surface is received on disc receiving seat 16 with its outer peripheral edge in electrical engagement with electrically conductive member 14. An electrically insulative membrane 22, such as Kapton, having a centrally located aperture 24 therethrough is received over conductive member 14 and disc 20.

An upper housing 26 of electrically insulative material having a plurality of downwardly depending legs or posts 28 is disposed on top of membrane 22 with an O-ring gasket 30 disposed therebetween and received in a groove 32 in the lower surface of housing 26. Posts 28 are received in bores 12 and heat staked in a conventional manner, as indicated at 29, to fix the upper housing 26 to base 10. Upper housing 26 is formed with a centrally disposed aperture 34 and a stationary contact 36 preferably mounted on a plurality of spokes 37 is insert molded in housing 26, leaving openings extending through aperture 34 for the reception of fluid therethrough. A terminal tab 38 extends radially outwardly therefrom. A groove 40 is formed in the upper surface of housing 26 and receives therein an O-ring 42 which seals the switch to a fluid pressure source in a transmission housing. The wall of housing 26 defining aperture 34 is formed with a filter seat 44 for the reception of a filter 46 (FIG. 1) to prevent gross contaminants from entering into the switching chamber in the vicinity of the stationary contact 36 and disc 20.

As mentioned above, the switch of FIGS. 1 and 2 have several limitations. When the switches are mounted in position on an automotive transmission housing the high loading used to ensure a good seal between elastomeric seal 42 and the transmission housing results in some inconsistency in the specific location of stationary contact 36 by causing web 23 and contact spoke 37 to bend. This changes the calibration of the switch and is undesirable and can even prevent the switch from opening.

Another limitation relates to the fact that the switch contacts are exposed to the working fluids of the transmission. Such fluid contains various contaminants, such as metal shavings from the transmission and insulating pieces both of which can cause problems with switch actuation. Although a filter can be used to exclude gross contaminants various films tend to build up on the contact and disc surfaces so that it is desirable to provide a high contact force in order to break through the film layers. However in the FIG. 1, 2 structure the contact force is limited to that value which equals the reaction of the snap acting disc which is defined by the switch point of the disc in response to a uniformly distributed pressure loading. That is, for a given pressure due to the uniform loading, a pressure actuated disc will snap at a higher pressure compared to a disc actuated by force converted from such pressure, as in the present invention. These limitations have been overcome in the preferred embodiment set forth in FIGS. 3–7.

Figure 3:
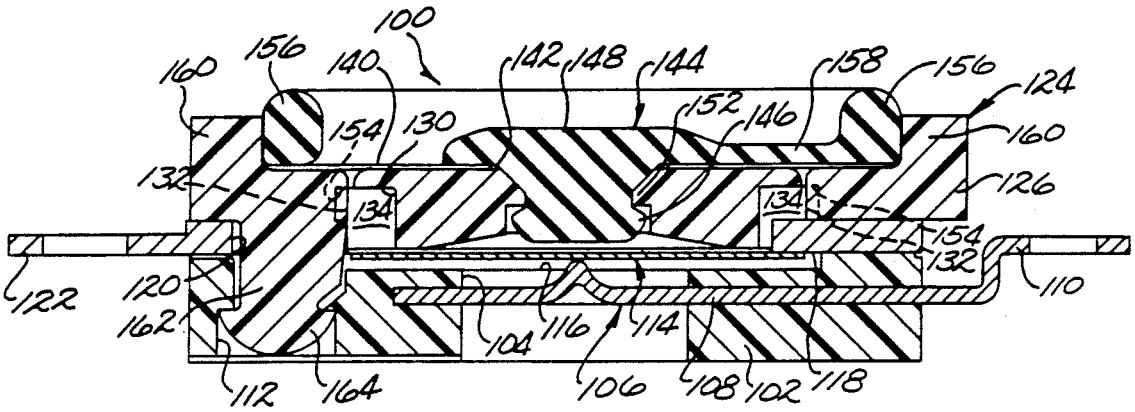
FIG. 3 is a cross sectional view similar to FIG. 1 of a switch made in accordance with the invention.

Switch 100 shown in FIG. 3 comprises a generally circular base 102 formed of electrically insulative material with a recess or bore 104 in which a stationary contact 106 is mounted, preferably by insert molding in the base a plurality of spokes 108 (one being shown) emanating from the contact. A terminal tab 110 extends from one of the spokes 108. A plurality of bores 112, preferably three, are formed through the base near the outer periphery to facilitate attachment of an upper housing to the base as will be discussed below.

A snap acting disc 114 of electrically conductive material is placed on a recessed portion 116 of base 102 with its normally convex side facing the stationary contact 106. It will be noted that the bottom wall of recessed portion 116 serves as a stop surface to protect disc 114 from the effects of any excessive force which might otherwise over stress the disc and shorten its useful life.

Figure 4:
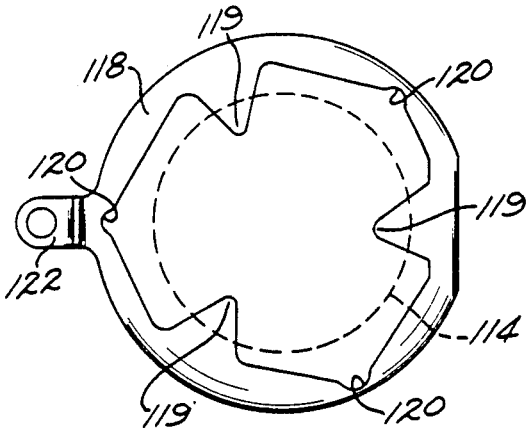
FIG. 4 is a top plan view of an electrically conductive member used in the FIG. 3 switch.

An electrically conductive member 118 formed of suitable rigid material such as nickel plated brass, is received over disc 114 and captures the disc within recessed portion 116. As best seen in FIG. 4, conductive member 118 is a generally annular member but is provided with three spaced, generally triangular contact tabs 119 extending generally inwardly from the rim of the annular member 118. It will be seen that snap acting disc 114 (see the dashed lines in FIG. 4}is received on these contact tabs which capture the disc and biases the disc in its normal at rest condition, against stationary contact 106.

Conductive member 118 is also provided with locating cut out portions or detents 120 which cooperate with posts depending from a retainer to be discussed below to fix the angular alignment of conductive member 118 as desired. A terminal tab 122 projects radially outwardly from member 118.

Figure 5:
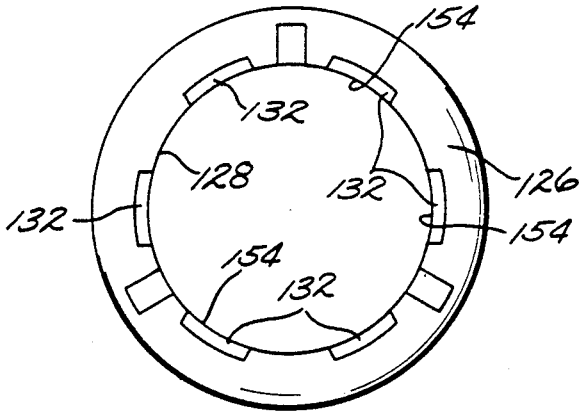
FIG. 5 is a bottom plan view of a retainer member used in the FIG. 3 switch.
Figure 6:
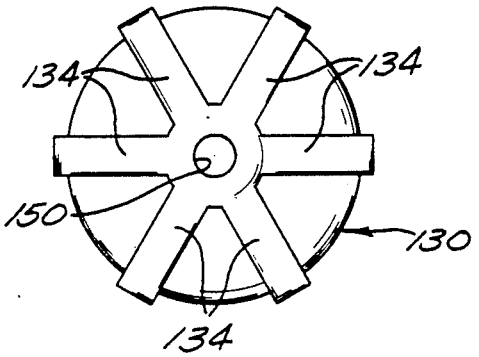
FIG. 6 is a bottom plan view of a pressure converter used in the FIG. 3 switch.
Figure 7:
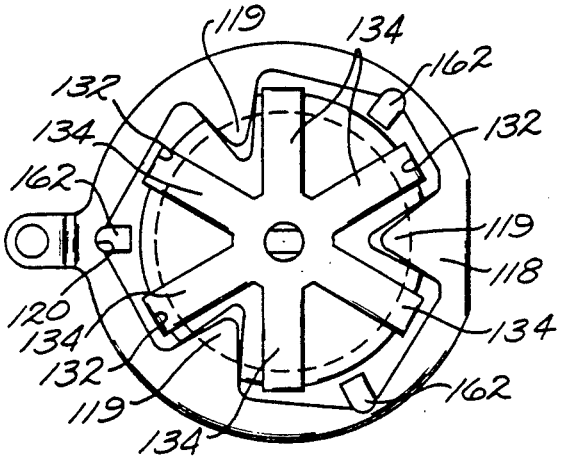
FIG. 7 is a bottom plan view showing the pressure converter mounted in the bore of the retainer member and showing the electrically conductive member of FIG. 4.

An upper housing 124 comprises a retainer member 126, a generally annular member formed of electrically insulative material having a bore 128 in which is slidably mounted a pressure converter 130. As seen in FIG. 5, retainer member 126 is provided with a plurality of notches 132 which communicate with the bore and the bottom surface of retainer member 126 and pressure converter 130, FIG. 6 has a plurality of ribs 134 on its lower surface which project out beyond the outer periphery of the pressure converter 130, each being receivable in a respective notch in order to maintain a selected angular position of the pressure converter relative to retainer member 126 and conductive member 118 as will be discussed below. The bottom surface of ribs 134 are tapered to form a recess 136 to allow the disc 114 space to snap to its opposite, concave downwardly facing position (not shown}. The bottom surface of ribs 134 at their outer ends are adapted to engage the top surface of disc 114 adjacent the outer periphery thereof.

A flexible membrane 140 of Kapton or the like, having a centrally disposed aperture 142 is located on the top surface of retainer 124 and pressure converter 130 and the several parts are held together by means of elastomeric seal means 144 which has a button portion 146 extending from hub 148. Button 146 projects through a bore 150 in retainer member 126 beyond restriction flange 152 to lock the pieces together. Upward movement of the pressure converter 130 is limited by a thin web 154 above notches 132. Seal means 144 has an outer O-ring portion 156 integrally attached to hub 148 by a plurality of spaced connector portions 158, one being shown. O-ring portion 156 is closely received within flange 160 extending upwardly from the outer periphery of retainer member 126. Retainer member 126 is also provided with a plurality of downwardly extending posts 162, each adapted to be received in a respective bore 112 in base 102 to be conventionally headed over as by heat staking in order to fixedly attach the upper housing to base 102 as indicated at 164.

Thus the invention described above provides a switch with markedly increased contact force, double or more, compared to the prior art ETC switch. This increase in contact force reduces the requirement for plating the contact surfaces with precious metal such as gold. The arrangement of the parts results in make and break segment contacts and continuous wiping action on the fixed center contact. The anti-rotation feature prevents the forming of plastic clutter and the locating and groove/rib features eliminate the possibility of piston/contact interference. The disc is protected from excessive force by means of the bottom wall of recessed portion 116 of base 102 which acts as a stop surface thereby extending the useful life of the disc. Loading the switch incident to assembling to a pressure source will not affect the position of the fixed contact due to the rigid structure extending from the O-ring seal to lower surface of the bottom housing. Dislodgement of the O-ring is avoided by fixing it to the retainer and the contact surfaces are isolated from the working fluid so that metal filings and other debris will not cause changes in calibration. Though the invention has been described with respect to a specific preferred embodiment thereof, many variations and modifications will immediately become apparent to those skilled in the art. For example, the flexible membrane and the O-ring seal could be formed from a single member if desired. Also, the switch could be made normally open by placing the snap acting disc on top of a conductive member in continuous engagement therewith with the normally concave side of the disc facing and adapted to engage a stationary contact upon snapping of the disc as disclosed in copending application Ser. No. 07/454,880 referenced above. It is therefore the intention that the appended claims be interpreted as broadly as possible in view of the prior art to include all such variations and modifications.

I claim:

1. A normally closed pressure switch comprising a generally circular base member formed of electrically insulative material having a centrally disposed recess formed in a top surface of the member, an electrical contact mounted on the base within the recess, a generally circular snap acting disc having a downwardly facing normally convex surface configuration received in the recess, an electrically conductive member disposed on top of the base member, the member having an effective opening therethrough smaller than the diameter of the disc to capture the disc within the recess with the outer circumference of the disc in electrical engagement with the conductive member and the center of the disc normally biased against the electrical contact, a retainer member disposed on top of the base member and the conductive member, the retainer member having a bore extending therethrough from top to bottom, a pressure converter comprising a generally circular element having a flat top surface and downwardly extending rib portion means adjacent its outer periphery slidably received in the bore of the retainer member, the rib portion means engageable with the disc at a location near its outer periphery but spaced inwardly therefrom, a flexible membrane received on top of the retainer member and pressure converter and means to form a fluid seal between the retainer member and the membrane whereby sufficient pressure of a fluid in contact with the top surface of the membrane will cause the membrane and pressure converter to move downwardly causing the disc to snap to a concave surface configuration facing the bottom surface of the recess with the disc out of electrical connection with the electrical contact and means to affix the base member to the retainer member.

2. A pressure switch according to claim 1 in which the retainer has a flange extending upwardly from the peripheral outer edge thereof, and the means to form a fluid seal comprises a flexible O-ring is received on top of the flexible membrane within the upwardly extending flange.

3. A pressure switch according to claim 1 in which the effective opening in the electrically conductive member includes a portion which is generally circular having a slightly larger diameter then the diameter of the snap acting disc and a plurality of contact tabs extend from the conductor member inwardly a selected distance sufficient to engage and capture the snap acting disc.

4. A pressure switch according to claim 3 in which there are three contact tabs generally evenly spaced around the annular member.

5. A pressure switch according to claim 1 in which the retainer member has a plurality of generally vertically extending spaced grooves formed therein communicating with the bottom surface and the bore of the retainer member but, having a top wall at the top of each groove and the pressure converter having a body provided with a plurality of radially extending ribs on the bottom surface of the body, each having a distal end portion extending outwardly beyond the body, each distal end portion received in a respective groove whereby angular movement of the converter relative to the retainer member is restricted and sliding movement of the pressure converter in an upward direction is limited by the top wall.

6. A pressure switch according to claim 5 in which the pressure converter and the flexible membrane are each provided with a centrally located bore extending therethrough and a connector is received through the bores to affix the membrane to the pressure converter.

7. A pressure switch according to claim 6 in which the means to form a fluid seal comprises a flexible O-ring disposed on top of the flexible membrane.

8. A pressure switch according to claim 7 in which the connector and the O-ring are integrally attached to one another.

9. A pressure switch according to claim 3 in which detent means are formed in the electrically conductive member and the means to affix the base member to the retainer member comprise a plurality of posts extending from one of the base member and retainer member receivable in respective bores formed in the other of the base member and the retainer member, the detent means receiving a portion of the posts to locate the contact tabs in a selected angular orientation.

10. A pressure switch according to claim 5 in which a plurality of contact tabs extend from the electrically conductive member into the opening of the electrically conductive member and in which detent means are formed in the electrically conductive member and the means to affix the base member to the retainer member comprise a plurality of posts extending from one of the base member and the retainer member receivable in respective bores formed in the other of the base member and the retainer member, the detent means receiving a portion of the posts to locate contact tabs in a selected angular orientation between adjacent ribs of the pressure converter.

11. A pressure switch comprising a generally circular base member formed of electrically insulative material having a centrally disposed recess formed in a top surface of the member, an electrical contact mounted on the base within the recess, a generally circular snap acting disc received in the recess, an electrically conductive member disposed on top of the base member, the member having an effective opening therethrough smaller than the diameter of the disc to capture the disc within the recess with the outer circumference of the disc electrically engageable with the conductive member and the center of the disc electrically engageable with the electrical contact, a retainer member disposed on top of the base member and the conductive member, the retainer member having a bore extending therethrough from top to bottom, a pressure converter comprising a generally circular element having a flat top surface and downwardly extending rib portion means adjacent its outer periphery slidably received in the bore of the retainer member, the rib portion means engageable with the disc at a location near its outer periphery but spaced inwardly therefrom, a flexible membrane received on top of the retainer member and pressure converter and means to form a fluid seal between the retainer member and the membrane whereby sufficient pressure of a fluid in contact with the top surface of the membrane will cause the membrane and pressure converter to move downwardly causing the disc to snap to an opposite surface configuration and means to affix the base member to the retainer member.

12. A normally closed pressure switch comprising a generally circular base member formed of electrically insulative material, an electrical contact mounted on the base, a generally circular snap acting disc having a downwardly facing normally convex surface configuration received on the base in alignment with the contact, an electrically conductive member disposed on top of the base member, the member having an effective opening therethrough smaller than the diameter of the disc with the outer circumference of the disc in electrical engagement with the conductive member and the center of the disc normally biased against the electrical contact, a retainer member disposed on top of the base member and the conductive member, the retainer member having a bore extending therethrough from top to bottom, a pressure converter comprising a generally circular element having a flat top surface and downwardly extending rib portion means adjacent its outer periphery slidably received in the bore of the retainer member, the rib portion means engageable with the disc at a location removed from the center of the disc, a flexible membrane received on top of the retainer member and pressure converter whereby sufficient pressure of a fluid in contact with the top surface of the membrane will cause the membrane and pressure converter to move downwardly causing the disc to snap to a concave surface configuration facing the bottom surface of the recess with the disc out of electrical connection with the electrical contact and means to affix the base member to the retainer member.

13. A pressure switch according to claim 1 in which the centrally disposed recess is defined by a bottom wall which serves as a stop surface for the disc to protect it from excessive force.

* * * * *